US007000956B2

(12) United States Patent
Fisher

(10) Patent No.: US 7,000,956 B2
(45) Date of Patent: Feb. 21, 2006

(54) LAST ASSEMBLY AND VEHICLE INCLUDING SUCH A LATCH ASSEMBLY

(75) Inventor: Sidney Edward Fisher, Shirley (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 0 days.

(21) Appl. No.: 09/861,068

(22) Filed: May 18, 2001

(65) Prior Publication Data

US 2001/0052705 A1 Dec. 20, 2001

(30) Foreign Application Priority Data

May 19, 2000 (GB) ..... 0011991

(51) Int. Cl.
*E05C 3/06* (2006.01)

(52) U.S. Cl. ..... 292/201; 292/198; 292/216; 292/DIG. 23; 292/DIG. 61; 70/262; 70/275

(58) Field of Classification Search ..... 292/201, 292/216, DIG. 61, DIG. 23, 198; 70/262, 70/263, 264, 275, 276, 277, 280, 281, 282, 70/283; 307/9.1, 10.1
See application file for complete search history.

(56) References Cited

U.S. PATENT DOCUMENTS

| | | | | |
|---|---|---|---|---|
| 3,961,504 A | * | 6/1976 | Sprecher | 70/1.5 |
| 4,518,180 A | | 5/1985 | Kleefeldt et al. | |
| 4,858,971 A | * | 8/1989 | Haag et al. | 292/201 |
| 5,127,686 A | * | 7/1992 | Gleason et al. | 292/216 |
| 5,497,641 A | * | 3/1996 | Linde et al. | 180/289 |
| 5,685,579 A | * | 11/1997 | Funk et al. | 292/216 |
| 5,802,894 A | | 9/1998 | Jahrsetz et al. | |
| 5,901,991 A | | 5/1999 | Hugel et al. | |
| 5,997,055 A | * | 12/1999 | Strathmann | 292/201 |
| 6,002,341 A | * | 12/1999 | Ohta et al. | 307/10.1 |
| 6,109,671 A | * | 8/2000 | Roncin et al. | 292/216 |
| 6,332,634 B1 | * | 12/2001 | Fukumoto et al. | 292/201 |
| 6,338,508 B1 | * | 1/2002 | Kleefeldt | 292/201 |
| 6,386,599 B1 | * | 5/2002 | Chevalier | 292/201 |

FOREIGN PATENT DOCUMENTS

| | | |
|---|---|---|
| DE | 3313702 | 10/1984 |
| DE | 197 00 887 A1 | 7/1998 |
| EP | 0 106 725 A1 | 9/1983 |
| EP | 0589158 | 3/1994 |
| EP | 0 978 609 A1 | 2/2000 |
| GB | 1 463 571 | 2/1997 |
| GB | 2 330 620 A | 4/1999 |

OTHER PUBLICATIONS

Search Report Under Section 17 dated Nov. 9, 2000.
European Search Report dated Aug. 3, 2003.

* cited by examiner

*Primary Examiner*—Brian E. Glessner
*Assistant Examiner*—Carlos Lugo
(74) *Attorney, Agent, or Firm*—Carlson, Gaskey & Olds

(57) ABSTRACT

A latch assembly includes a latch bolt, a retaining member and an actuator. The latch bolt is moveable between a closed position at which it is capable of retaining a striker and an open position at which the striker is released. The retaining member is moveable between a retained position at which it retains the latch bolt in at least its closed position and released position at which the latch bolt can move between its opened and closed positions. The actuator is capable of moving the retaining means from its engaged position to its released position, in which, under normal operating conditions of the latch, the actuator is the sole means of releasing the latch.

20 Claims, 6 Drawing Sheets

LATCHED

OPEN

UNLATCHED

LATCHED

LAST ASSEMBLY AND VEHICLE INCLUDING SUCH A LATCH ASSEMBLY

BACKGROUND OF THE INVENTION

The present invention relates to latch assemblies and vehicles including such latch assemblies, in particular latch assemblies for use in cars.

Known latch assemblies for use in cars include mechanical arrangements to allow unlatching and locking/unlocking of the latch.

Thus inside door handles are typically connected by rods or cables to the latch to allow opening of the door by operation of the inside door handle. Similarly outside door handles are mechanically connected to the latch, to allow opening of the door by operation of the outside door handle. Furthermore exterior key barrels, operable by keys are connected by mechanical linkages to the latch to allow locking and unlocking of the door from the outside and sill buttons and the like are again connect connected to the latch to allow locking and unlocking of the latch. Furthermore child safety mechanisms are typically mounted on rear doors on the vehicles so as to prevent opening of the door by operation of the inside door handle, independent of whether or not that door is locked.

Thus known vehicles must include many mechanical elements to provide for a full range of functions relating to the door latches.

SUMMARY OF THE INVENTION

An object of the present invention is to provide for a simplified door latch, requiring fewer components.

Another object of the present invention is to provide for a vehicle having a door latch system with fewer components.

Thus according to the present invention there is provided a latch assembly including a latch bolt, a retaining means and an actuator, the latch bolt being moveable between a closed position at which it is capable of retaining a striker and an open position at which the striker is released, the retaining means being moveable between a retained position at which it retains the latch bolt in at least its closed position and a released position at which the latch bolt can move between its opened and closed positions, the actuator being capable of moving the retaining means from its engaged position to its released position, in which, under normal operating conditions of the latch, the actuator is the sole means of releasing the latch.

Advantageously this allows for simple switches to be connected by circuitry to the latch instead of inside and outside door handles connected by via mechanical linkages.

According to a further aspect of the present invention there is provided a latch assembly including a latch bolt, a retaining means and an actuator, the latch bolt being moveable between a closed position at which it is capable of retaining a striker and an open position at which the striker is released, the retaining means being moveable between a retained position at which it retains the latch bolt in at least it closed position and a released position at which the latch can move between its open and closed positions, the actuator being capable of moving the retaining means from its engaged position to its released position, in which the actuator is biased towards an at rest position, wherein the retaining means is capable of achieving it retained position, by a resilient means.

According to a further aspect of the present invention there is provided a latch assembly including a latch bolt, a retaining means, an actuator and a cam, the latch bolt being moveable between a closed position at which it is capable of retaining a striker and open position at which the striker is released, the retaining means being moveable between a retained position at which it retains the latch bolt in at least its closed position and a released position at which the latch bolt can move between its closed and open positions, the retaining means further including an actuation abutment, the actuator being operable to move the cam, the cam surface engaging the actuation abutment of the retaining means to move the retaining means to its released position.

Advantageously this provides for a latch assembly of simplified design.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 3:
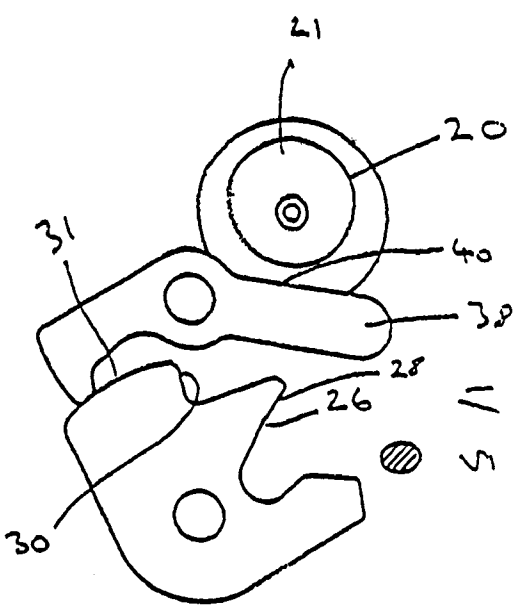
FIGS. 1 to 3 show part views of a latch assembly according to the present invention, in a latch, unlatched and open condition.
Figure 2:
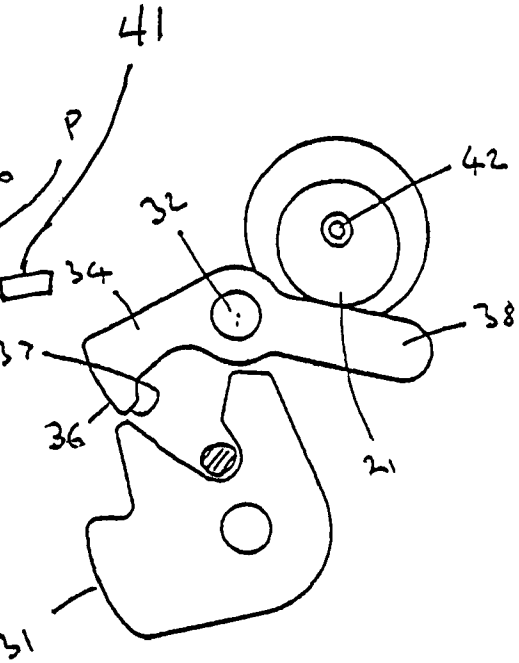
Figure 1:
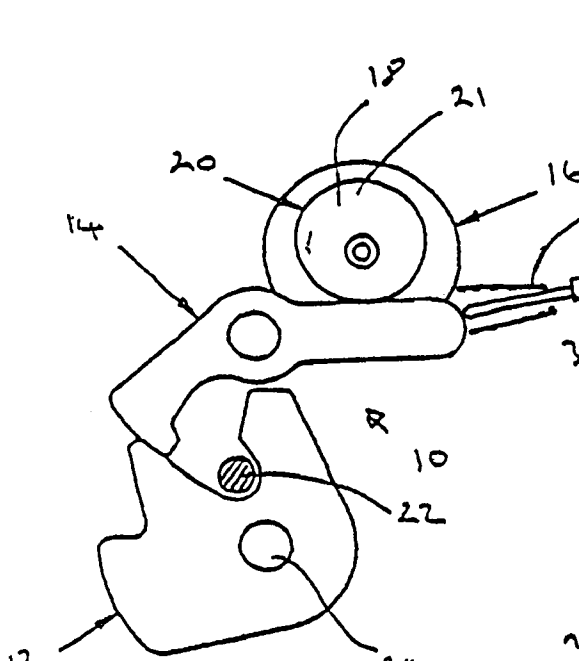

With reference to FIGS. 1 to 3 there is shown a latch assembly 10 including a latch bolt in the form of a rotating claw 12, a retention means in the form of a pawl 14 an actuator in the form of an electric motor 16, and a cam 18.

Rotating claw 12 is pivotable about claw pin 24 from a closed position as shown in FIG. 1 to an open position as shown in FIG. 3. Claw 12 includes a mouth 26 a closed abutment surface 28 and a first safety abutment surface 30.

Pawl 14 is pivotable about pawl pin 32 and includes a first arm 34 having a first abutment surface 36 and a second arm 38 having a second abutment surface 40.

Electric motor 16 includes an output shaft 42 upon which is directly mounted cam 18.

In this case cam surface 20 is circular but since cam 18 is mounted eccentrically relative to output shaft 42, this arrangement provides for a single lobe cam.

Operation of the latch assembly is as follows.

Consideration of FIG. 1 shows a striker 22 retained in mouth 26, with claw 12 being retained in its closed position by closed abutment surface 28 co-operating with first abutment 36.

Under these circumstances the door upon which striker 22 is mounted would be in a fully closed position.

Note that it is possible for striker 22 to be retained in mouth 26 whilst first safety abutment surface 30 co-operates with first abutment surface 36. Under such circumstances the associated door would be in a first safety position i.e. unable to be opened but nevertheless not in a fully closed position.

It should be note from FIG. 1 that second abutment surface 40 is in contact with cam surface 20 but cam lobe 21 is remote from second abutment surface 40, thus allowing engagement between closed abutment surface 28 and first abutment surface 36.

A pulse of current is fed to the motor such that it causes the cam to continuously rotate through 360°.

Initial operation of the motor 16 causes the cam 18 to rotate to the position shown in FIG. 2 where cam lobe 21 is proximal second abutment surface 40 thus causing pawl 14 to rotate in a clockwise direction about pawl pin 32 hence disengaging first abutment surface 36 from closed abutment surface 28.

When the latch is passing through the position as shown in FIG. 2, elastomeric door seals acting between the associated door and the adjacent portion of the vehicle causes the door to open such that the striker 22 moves to the right as shown in the figure relative to the latch thereby causing the claw 12 to rotate in a clockwise direction with viewing FIG. 2, such that surface 31 of the claw moves to a position opposite surface 37 of the pawl.

With continued rotation of the motor and hence cam surface 20, the lobe 21 achieves the position as shown in FIG. 3, i.e. remote from second abutment surface 40 where upon the motor stops. It should be noted from FIG. 3 that cam surface 20 does not engage second abutment surface 40 since these two surfaces are being held apart by co-operation of surfaces 37 of pawl engaging surface 31 of the claw.

When the door is closed, striker 22 enters mouth 26 causing claw 12 to rotate in a clockwise direction from the position shown in FIG. 3 to the position shown in FIG. 1 whereby surfaces 37 and 31 disengage thus allowing engagement of first abutment 36 with closed abutment surface 28.

In this case the motor 16 is the sole means of releasing the latch under normal operating conditions. The term normal operating conditions should be construed as meaning those conditions under which an end user of the vehicle would normally open and close the associated door.

In this case an access path P (shown schematically) is provided in order to open the latch under abnormal operating conditions. Thus when a vehicle is being assembled on a assembly line an independent means 41 such as a screwdriver or other generally elongate element can be passed through the access path in order to operate the pawl 14 to open the latch independent of operation of the motor. Thus advantageously the door can be fitted and aligned and checked for correct opening and closing in the absence of a power source such as the vehicle battery or a slave battery. The term access path P should be construed to mean an arrangement of components that allows access of the independent means 41.

With reference to FIGS. 4 to 8 there is shown part views of a further embodiment of a latch assembly 10' including a retention means in the form of a pawl 14' having a second arm 38' Pawl 14' is mounted similar to pawl 14, and engages a rotating claw (not shown).

Latch assembly 10' further includes a cam 18' having a cam surface 20' with a cam lobe 21'. Cam 18' is rotatable about axis A which in this case is coincident with an output shaft of an electric motor (not shown).

In this case a resilient means in the form of a tension spring 44' is secured under tension between fixing pin F mounted on a chassis of the latch assembly and connection pin C mounted on the cam 18'.

Operation of the latch assembly 10 is as follows.

Figures 4, 5, 6, 7, 8:
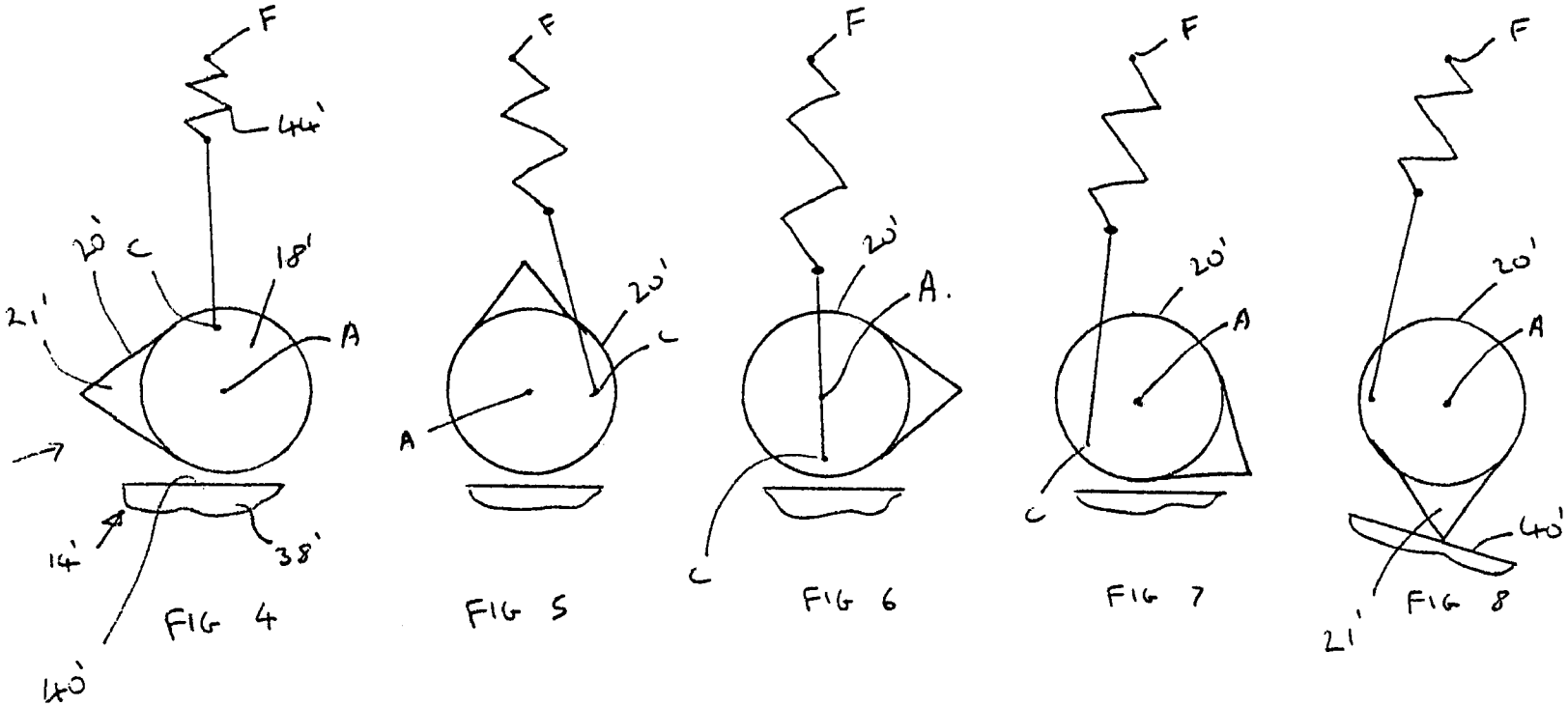
FIGS. 4 to 8 show part views of a further embodiment of a latch assembly according to the present invention when it moves from a latched condition to an unlatched condition.

Consideration of FIG. 4 shows the pawl 14' in an engaged position, and in particular cam lobe 21' does not contact second abutment surface 40'.

Operation of the motor causes the cam 18' to rotate clockwise through 360°. During part of this 360° movement the cam lobe 21' engages second abutment surface 40' causing pawl 14' to rotate clockwise when viewing the figures thus allowing the latch to open (see FIG. 8).

Consideration of FIG. 4 shows that tension spring 44' biases the cam 18' to the position shown in FIG. 4 since this is the position at which the distance between connection pin C and fixing pin F is a minimum. In this position cam 18' is in a stable equilibrium position i.e. a small rotation of cam 18' clockwise or anticlockwise will result in the cam returning to the position as shown in FIG. 4.

Consideration of FIG. 5 shows the cam having been rotated through 90° whereupon tension spring 44' has been extended.

Consideration of FIG. 6 show the tension spring being further extended with the cam having being rotated through 180°. In this case axis A is on a line joining connection pin C to fixing pin F. Whilst this position is being moves through transiently, nevertheless the cam 18' is momentarily in an unstable equilibrium position. Thus should the motor fail in this position, the cam would remain in this position but should the cam be slightly displaced clockwise the spring would move the cam clockwise to the position as shown in FIG. 4 and should the cam be displaced slightly anticlockwise the spring would move the cam to anticlockwise to the position as shown in FIG. 4.

Consideration of FIG. 7 shows that the cam has moved beyond the unstable equilibrium position of FIG. 6.

It should be noted that during all the movement of the cam from FIG. 4 to the position shown in FIG. 7, the cam surface 20' does not engage the second abutment surface 40' of the pawl 14'.

Thus it is only during the latter part of the rotation of the cam that the cam lobe 21' engages second abutment surface 40' to move the pawl 14' to a disengaged position (as shown in FIG. 8).

In particular the tension spring 44' can be designed such that the amount of power required to move cam from the position shown in FIG. 4 to the position shown in FIG. 6 is greater than the amount of power required to open the latch. Thus under these circumstances if the motor was to fail such that it lost power, then subsequent operation of the motor to open the door would result in the motor being unable to move the cam from the position shown in FIG. 4 to the position shown in FIG. 6. Under these circumstances the door would remain closed which is preferred to a door that cannot be retained in a closed position.

Furthermore the tension spring 44' can also be designed such that if the motor loses all power when the cam is in the position as shown in FIG. 7, the tension spring has sufficient energy stored therein to move the cam from the position as shown in FIG. 7 to the position as shown in FIG. 4. Again this results in a door that can be held in a closed position.

Figure 14:
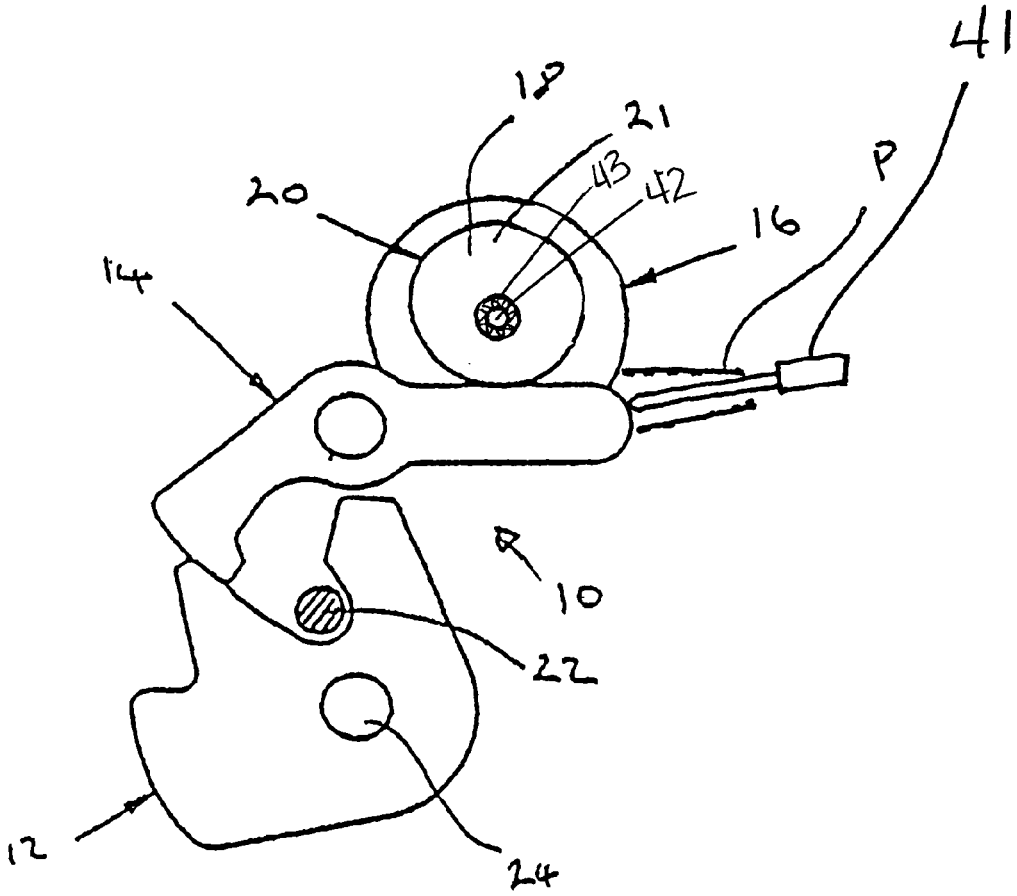
FIG. 14 illustrates the latch assembly in a latched condition having a gear system between the output shaft and the cam.
Figure 1:
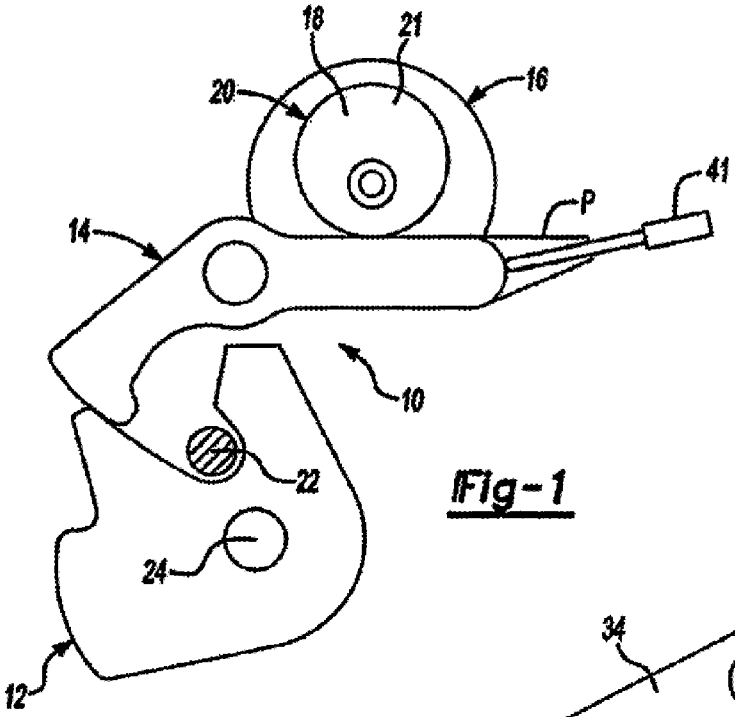
Figure 2:
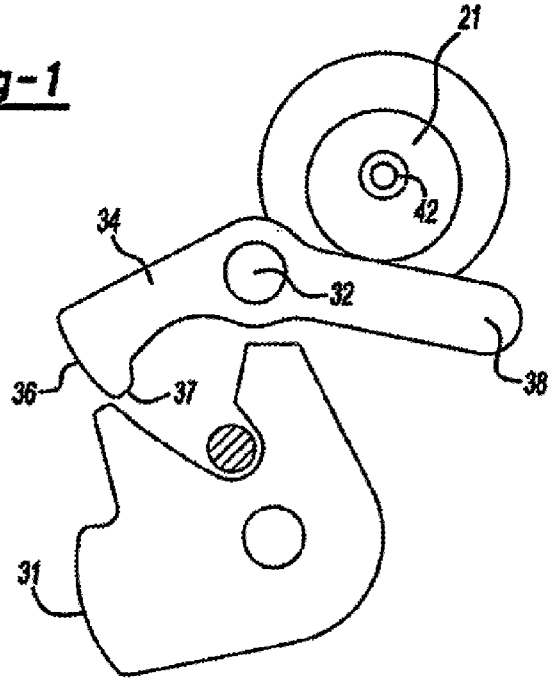
Figure 3:
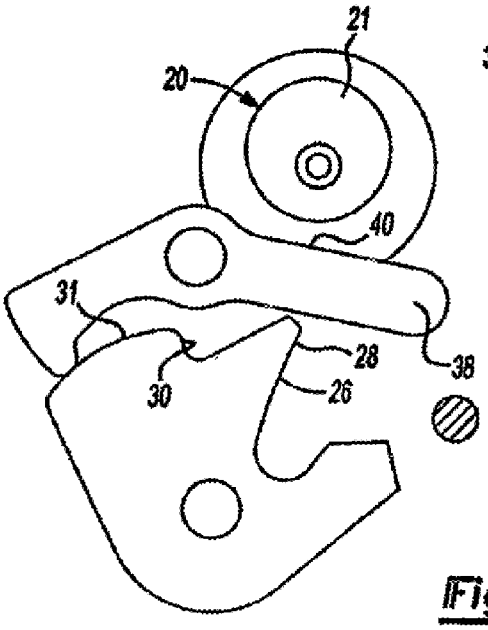
Figure 4:
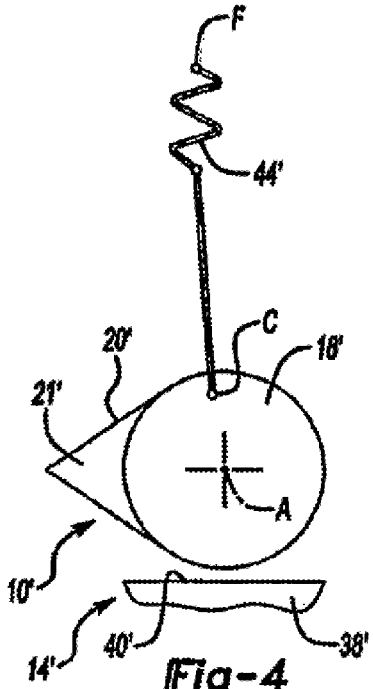
Figure 5:
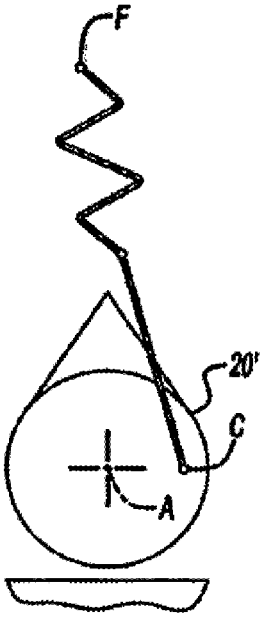
Figure 6:
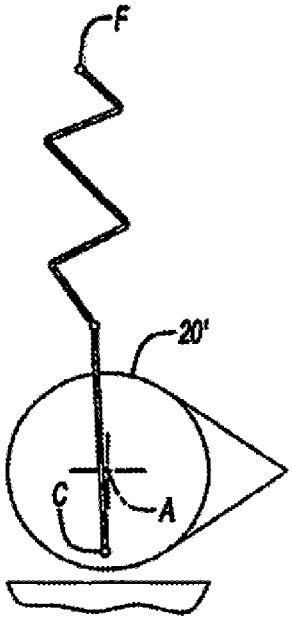
Figure 7:
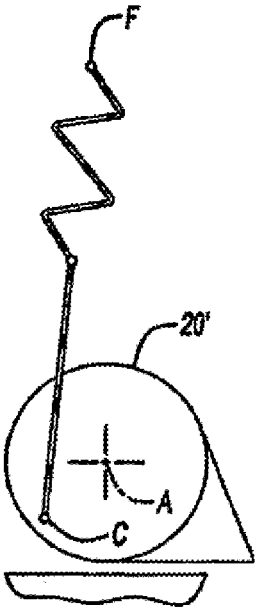
Figure 8:
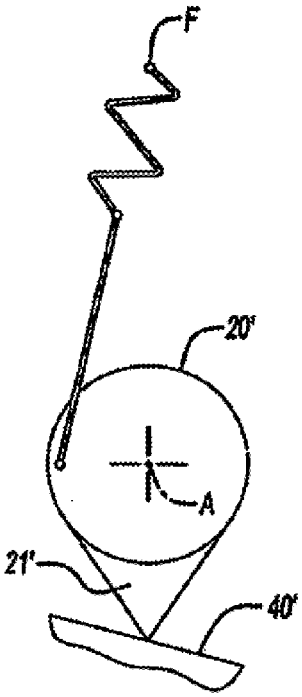
Figure 9:
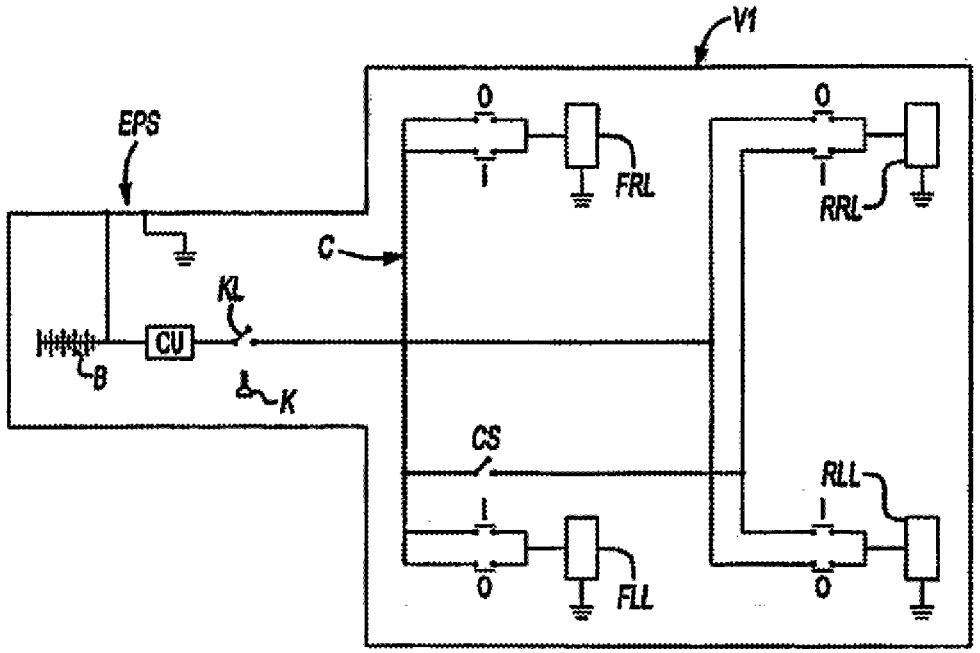
Figure 10:
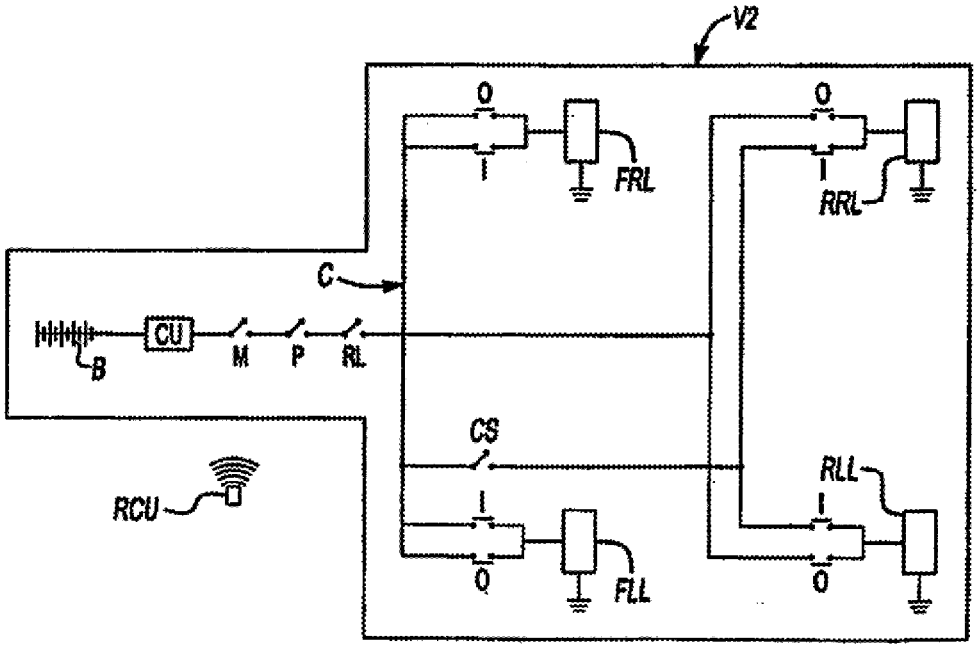
Figure 11:
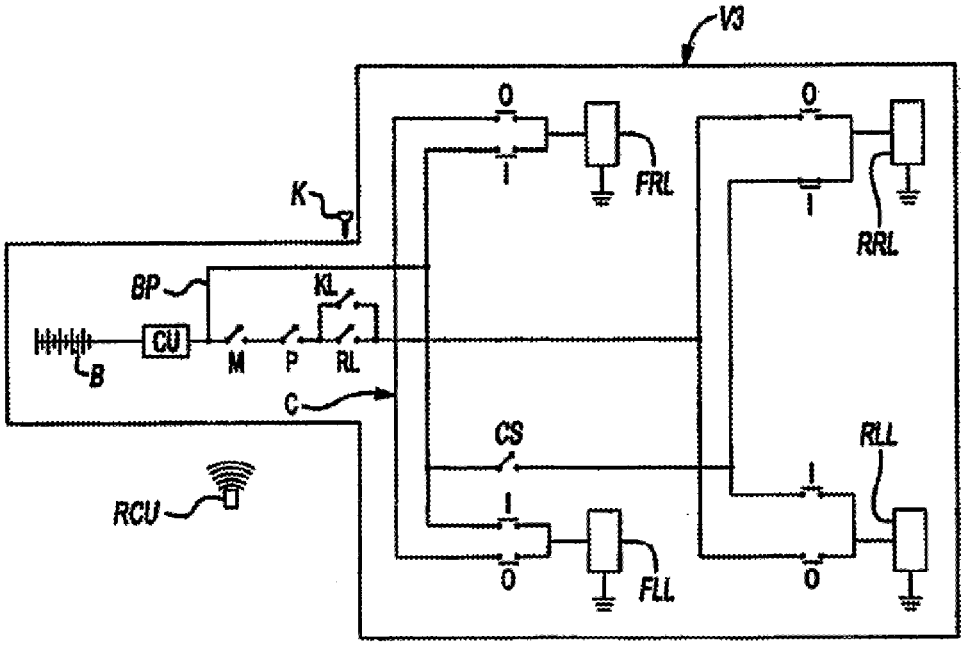
Figure 12:
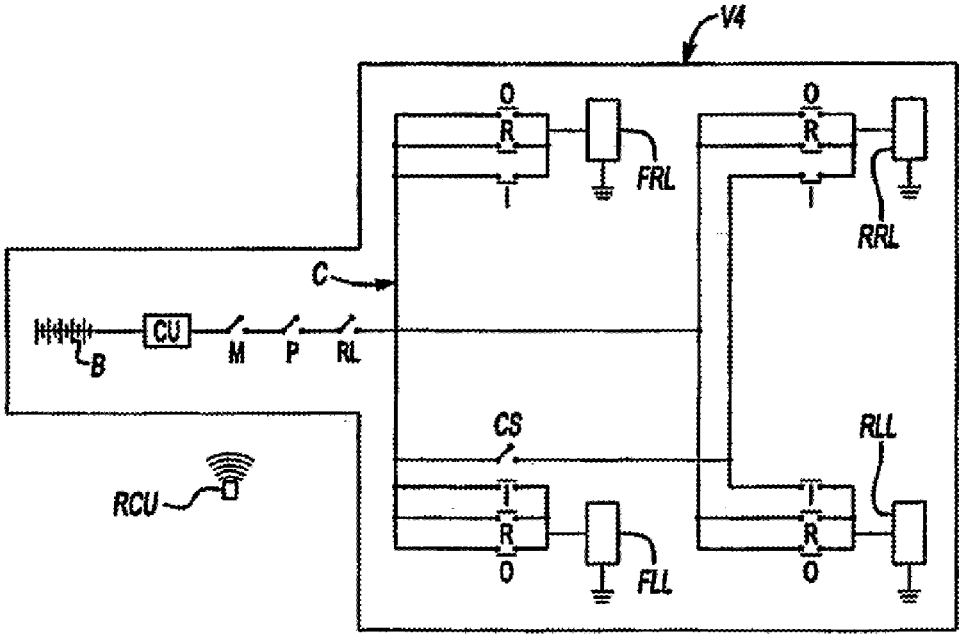
Figure 13:
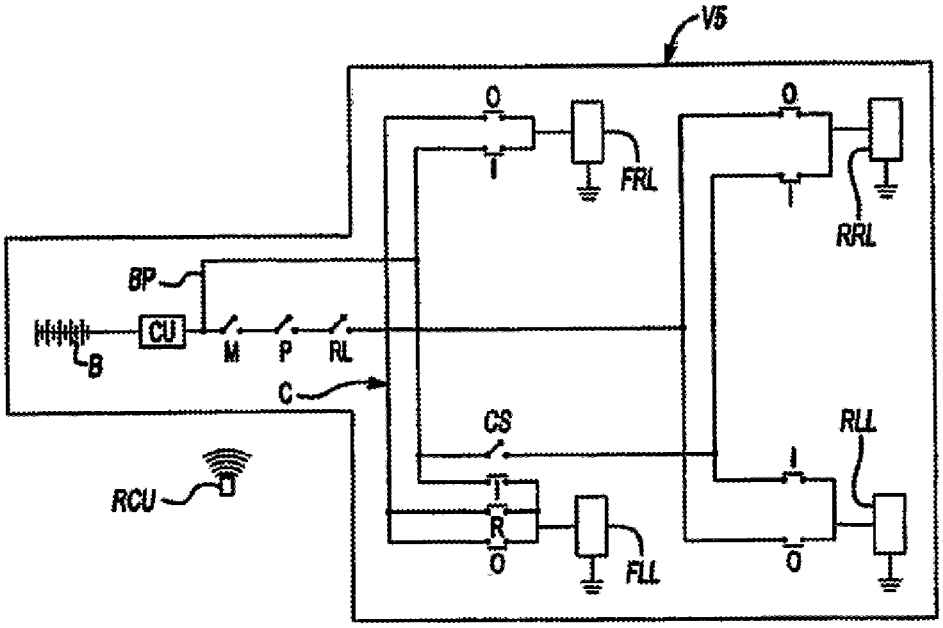
Figure 14:
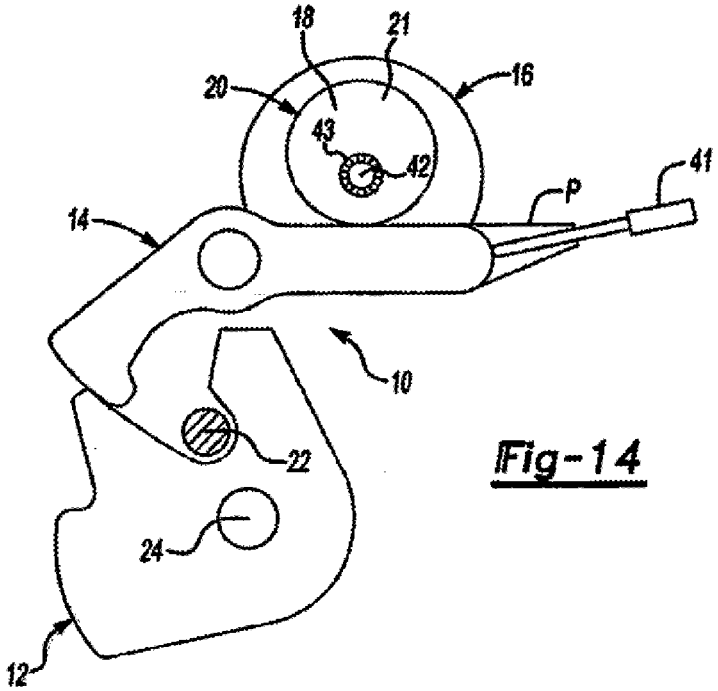

In further embodiments alternative latch bolts could be used, in particular non rotating latch bolts. Furthermore alternative retention means could be used. Furthermore alternative actuators such as pneumatic or hydraulic actuators could be used. Furthermore the cam need not be mounted directly on the actuator output shaft, for example, as shown in FIG. 14, a gear system 43 could be used between the output shaft 42 of the actuator and the cam 18.

With reference to FIGS. 9 to 13 there is shown schematic views of vehicles V1 to V5 according to the present invention.

For ease of reference the following references will be used, where appropriate on all FIGS. 9 to 13.

| | | | |
|---|---|---|---|
| B = Battery | CU = Control Unit | M = Motion Switch | P = Panic Switch |
| RL = Remote Locking Switch | O = Outside Switch | I = Inside Switch | R = Remote Switch |
| CS = Child Safety Switch | FRL = Front Right Latch | FLL = Front Left Latch | RRL = Rear Right Latch |
| RLL = Rear Left Latch | K = Key | KL = Key Locking Switch | EPS = Emergency Power Socket |
| C = Circuit | BP = Bypass | | |

The switches for fall into two classes. Thus the outside switches, insides switches, and remote switches are all biased to an open position with a positive action (either manual or from the remote control unit) required to close the switches. Thus these switches can be regarded as enabling switches.

The motion switch, panic switch, remote locking switch and child safety switch are all bi-stable switches, that is to say they have a stable open position and a stable closed position and can be regarded as disabling switches.

Consideration of FIGS. 9 to 13 shows in all cases four latches used to secure appropriate doors (not shown).

Each latch has an associated outside switch manually operable from the outside of the vehicle and an associated inside switch manually operable from the inside of the vehicle. Typically the outside and inside switches would be located proximate associated doors.

A child safety switch, typically located within reach of a driver of the vehicle, is operable to disable opening of the rear doors by operating the inside switches associated with those rear doors.

A battery is provided to supply power to allow the latches to operate and a control unit is also supplied to co-ordinate latch opening.

The components of the system are connected by circuitry, in this case an electric circuit.

Specific features of vehicle V1 are as follows:

A key locking switch is provided in series with all latches, thus disabling the latches by operation of the key. Furthermore an emergency power socket is provided which is conveniently mounted on an outer surface of the vehicle such that emergency power can be supplied to the circuit in the event that the battery goes flat.

Figure 9:
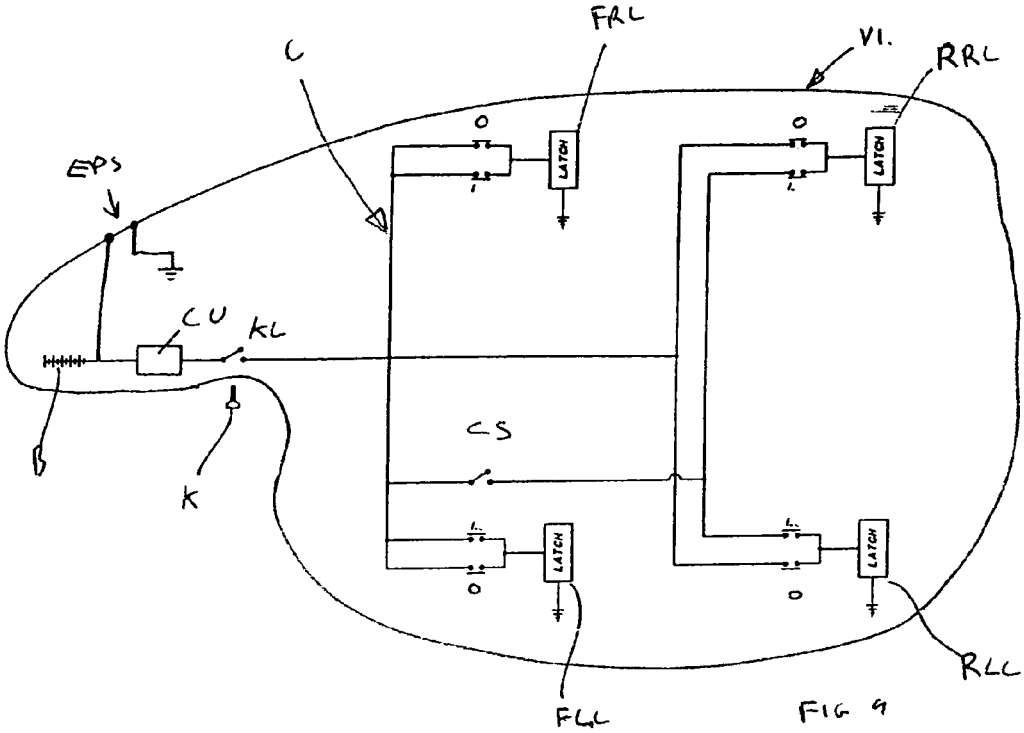
FIGS. 9 to 13 show alternative embodiments of vehicles according to the present invention.
Figure 10:
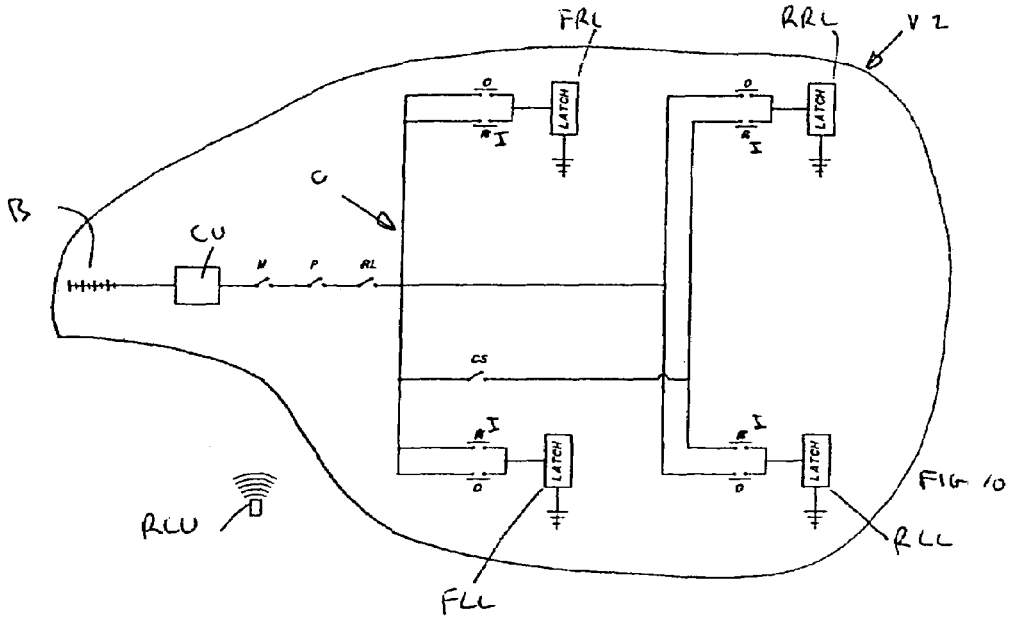
Figure 11:
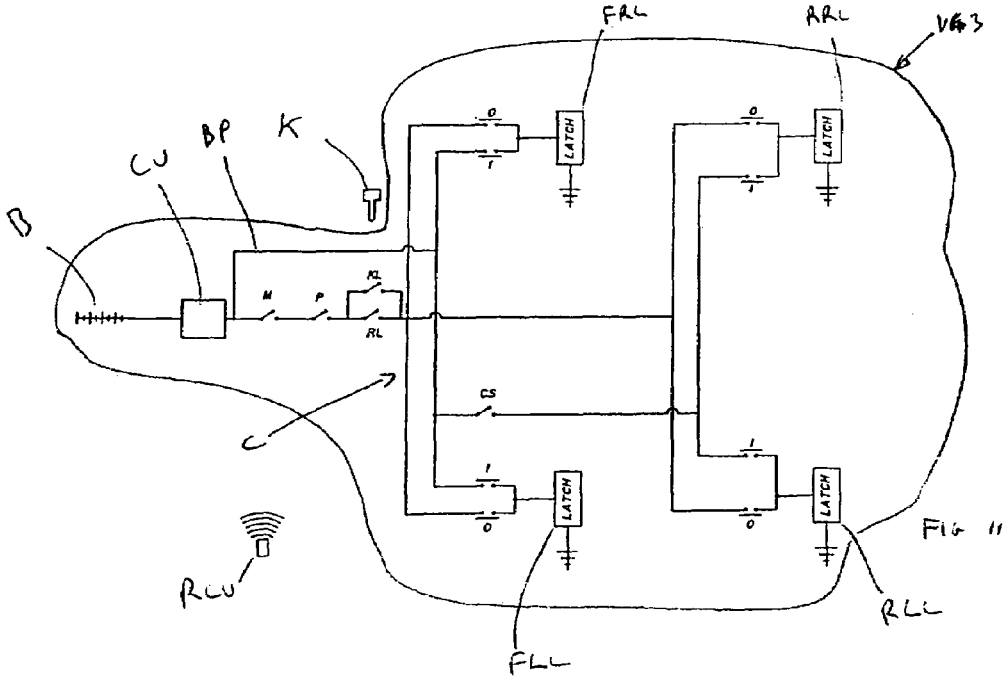
Figure 12:
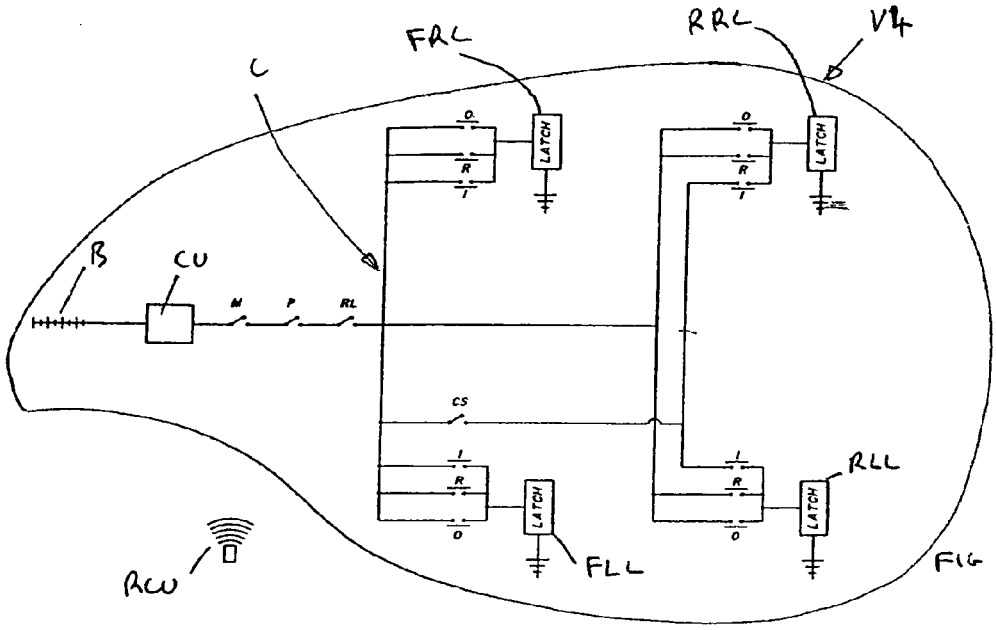
Figure 13:
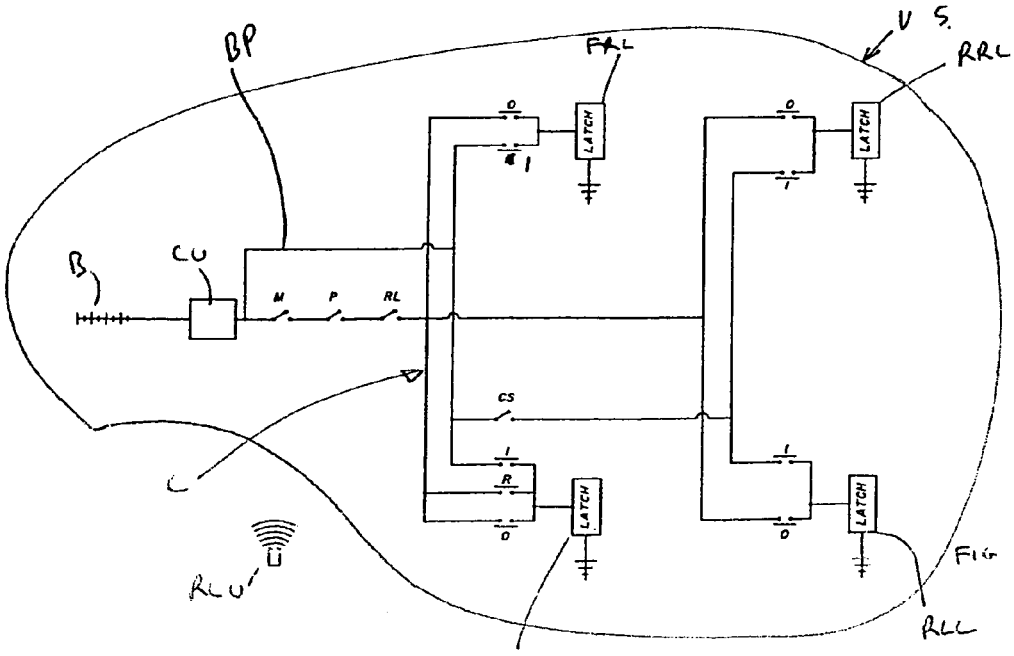

It can be seen from FIG. 9 that with the key locking switch in the position shown in FIG. 9 the vehicle is effectively locked in a superlocked condition thus operation of any outside or inside switch will not open the associated door. To unlock the vehicle, the key can be used to move the key lock switch to a closed position whereupon operation of any inside or outside switch will open the door (provided the child safety switch is in the closed position).

With the child safety in the open position as shown in FIG. 9 operation of the rear inside switches will never open the associated door.

Specific features of vehicles V2 are as follows:

A motion switch is included in series with all latches. Thus with the vehicle in motion, the motion switch automatically opens thus disabling the inside and outside switches.

A panic switch, mounted typically within easy reach of a driver of a vehicle is provided in series with all latches. Thus opening of the panic switch will automatically lock all doors.

A remote locking switch is provided in series with all latches. The locking switch can be operated by a manually operated remote control unit. Thus to unlock the vehicle the remote control unit is operable to send a signal to the control unit which then ensures that the motion switch, the panic switch and the remote locking switch moves to a closed position whereupon the vehicle is unlocked. The vehicle can also be locked by operation of the remote control unit which then sends a signal to the control unit to open the remote locking switch.

Specific features of vehicle V3 are as follows:

A key locking switch is provided in parallel with the remote locking switch enabling the vehicle to be locked and unlocked by a key or by the remote control unit. Thus locking by the key causes the key lock switch and the remote locking switch to open, locking by the remote control unit causes the key locking switch and the remote locking switch to open, unlocking by the key causes the control unit to confirm the motion switch and panic switch are closed and also to close the key locking switch and unlocking by the remote control unit causes the control unit to confirm the motion switch and panic switch are closed and to closed the remote locking switch.

It should also be noted that the circuit of vehicle V3 includes a bypass with bypasses the motion switch, panic switch, key lock switch and remote lock switch. Thus always providing power to the front inside switches. Thus operation of the front inside switches always opens the front doors and hence the vehicle can never the put into a superlocked condition. Typically such an arrangement would be found on cars for the North American market.

Specific vehicles of vehicle V4 are as follows:

A remote locking switch is provided in series with all latches to provide for locking and unlocking of the vehicle. Each latch has an associated remote switch operable via the control unit by signals from the remote control unit. In this case the remote control unit has one button for operation of the remote locking switch and four button for operation of the four remote switches. Thus the vehicle can be unlocked by pressing the button on the remote control unit associated with the remote locking switch. If only this button is pressed then all doors remains shut. However, if subsequently one or more button on the remote control unit associated with the remote switches are pressed then the associated latches are opened and the associated doors will spring open under the influence of the doors seals.

Specific features of vehicle V5 are as follows:

In this case a remote locking switch is provided in series with the latches for locking the vehicle. However, only one remote switch is provided in this case associated with the latch of the drivers door (note left-hand drive vehicle) thus in one embodiment the remote control unit can have a single button which when pressed unlocks the vehicle by closing the remote locking switch and also closes the remote switch associated with driver door thus opening the door. When the driver exits the vehicle further pressing of the button causes the remote locking switch to open.

Alternatively the remote control unit may have two buttons one dedicated to operating the remote locking switch and a further button dedicated to operating the remote switch of the drivers door. Thus the vehicle can be unlocked whilst all doors remain shut.

It should be noted that FIGS. 9 to 13 show the various elements of the vehicles in positions which aid the understanding of the invention. However, the various switches and control units could be positioned at various locations on the vehicle, in particular the motion switch and remote locking switch could be located in the control unit.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch assembly comprising:

a chassis;

a latch bolt moveable between a closed position at which the latch bolt is capable of retaining a striker and an open position at which the striker is released;

a retaining member moveable between a retained position at which the retaining member retains the latch bolt in the closed position and a released position at which the latch bolt is moveable between the open position and the closed position; and an actuator having a rest position and an unstable equilibrium position and being capable of moving the retaining member from the retained position to the release position; and a resilient member operable to move the actuator to the rest position, the actuator and the resilient member together defining the unstable equilibrium position of the actuator relative to the chassis, wherein operation of the actuator causes the actuator to pass through the unstable equilibrium position before the retaining member achieves the release position.

2. The latch assembly as defined in claim 1 wherein the retaining member starts to move from the retained position only after the actuator has passed through the unstable equilibrium position.

3. The latch assembly as defined in claim 1 wherein the resilient member is capable of moving the retaining member to the released position once the actuator has passed through the unstable equilibrium position.

4. The latch assembly as defined in claim 1 wherein energy stored in the resilient member when the actuator moves from the rest position to the unstable equilibrium position is substantially equal to or greater than the energy required to move the retaining member from the retained position to the released position.

5. The latch assembly as defined in claim 1 wherein the actuator is an electric motor.

6. The latch assembly as defined in claim 1 wherein the latch bolt is a rotating claw.

7. The latch assembly as defined in claim 1 further including a cam having a cam surface and rotatable about an axis, and wherein the actuator operably moves the retaining member via the cam surface.

8. The latch assembly as defined in claim 1 wherein the retaining member further includes a first arm having a surface for engagement with the latch bolt and a second arm having an abutment surface operably actuated by the actuator.

9. The latch assembly as defined in claim 1 wherein the retaining member is a pivotable pawl.

10. The latch assembly as defined in claim 7 wherein the actuator includes a rotating output shaft for driving the cam.

11. The latch assembly as defined in claim 10 wherein the actuator is a motor including the rotating output shaft, and the cam is mounted on and directly driven by the output shaft.

12. The latch assembly as defined in claim 10 wherein the output shaft drives the cam via a gear system.

13. The latch assembly as defined in claim 7 wherein the cam is a single lobe cam.

14. A latch assembly comprising:

a chassis;

a latch bolt moveable between a closed position at which the latch bolt is capable of retaining a striker and an open position at which the striker is released;

a retaining member moveable between a retained position at which the retaining member retains the latch bolt in the closed position and a released position at which the latch bolt is moveable between the open position and the closed position; and an actuator having a rest position and an unstable equilibrium position and being capable of moving the retaining member from the retained position to the released position; and a resilient member operable to move the actuator to the rest position, and the actuator and the resilient member together defining the unstable equilibrium position of the actuator relative to the chassis, wherein energy stored in the resilient member when moving from the rest position to the unstable equilibrium position is substantially equal to or greater than the energy required to move the retaining member from the retained position to the released position.

15. The latch assembly as recited in claim 14 wherein the retaining member starts to move from the retained position only after the actuator has passed through the unstable equilibrium position.

16. The latch assembly as recited in claim 14 wherein the resilient member is capable of moving the retaining member to the released position once the actuator has passed through the unstable equilibrium position.

17. The latch assembly as recited in claim 1 wherein the chassis includes a fixing pin and the actuator includes a cam having a connector pin and a cam surface, and the cam is rotatable about an axis, wherein the actuator operably moves the retaining member by the cam surface, and the resilient member is a spring secured to the fixing pin on the chassis and the connector pin on the cam, end wherein the unstable equilibrium position is defined when the axis lies on a line joining the connector pin to the fixing pin.

18. The latch assembly as recited in claim 14 wherein the chassis includes a fixing pin and the actuator includes a cam having a connector pin and a cam surface, and the cam is rotatable about an axis, wherein the actuator operably moves the retaining member by the cam surface, and the resilient member is a spring secured to the fixing pin on the chassis and the connector pin on the cam, and wherein the unstable equilibrium position is defined when the axis lies an a line joining the connector pin to the fixing pin.

19. The latch assembly as defined in claim 14 wherein the actuator is an electric motor.

20. The latch assembly as defined in claim 14 wherein the latch bolt is a rotating claw.

* * * * *

UNITED STATES PATENT AND TRADEMARK OFFICE

CERTIFICATE OF CORRECTION

PATENT NO. : 7,000,956 B2
APPLICATION NO. : 09/861068
DATED : February 21, 2006
INVENTOR(S) : Fisher It is certified that error appears in the above-identified patent and that said Letters Patent is hereby corrected as shown below:

On the title page item (54) and col. 1, line 1, should read as --LATCH ASSEMBLY AND VEHICLE INCLUDING SUCH A LATCH ASSEMBLY--.

The title page showing the illustrative figure should be deleted to be replaced with the attached title page.

The drawing sheets, consisting of Figs. 1-14, should be deleted to be replaced with drawing sheets, consisting of Figs. 1-14, as shown on the attached pages.

Claim 17, Column 8, Line 48 of the issued patent, “end” should read as --and--.

Claim 18, Column 8, Line 58 of the issued patent, “an” should read as --on--.

Signed and Sealed this

Twenty-first Day of November, 2006

JON W. DUDAS
*Director of the United States Patent and Trademark Office*

(12) United States Patent
Fisher

(10) Patent No.: US 7,000,956 B2
(45) Date of Patent: Feb. 21, 2006

(54) LAST ASSEMBLY AND VEHICLE INCLUDING SUCH A LATCH ASSEMBLY

(75) Inventor: Sidney Edward Fisher, Shirley (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 0 days.

(21) Appl. No.: 09/861,068

(22) Filed: May 18, 2001

(65) Prior Publication Data

US 2001/0052705 A1 Dec. 20, 2001

(30) Foreign Application Priority Data

May 19, 2000 (GB) ..... 0011991

(51) Int. Cl.
*E05C 3/06* (2006.01)

(52) U.S. Cl. ..... 292/201; 292/198; 292/216; 292/DIG. 23; 292/DIG. 61; 70/262; 70/275

(58) Field of Classification Search ..... 292/201, 292/216, DIG. 61, DIG. 23, 198; 70/262, 70/263, 264, 275, 276, 277, 280, 281, 282, 70/283; 307/9.1, 10.1

See application file for complete search history.

(56) References Cited

U.S. PATENT DOCUMENTS

| | | | | |
|---|---|---|---|---|
| 3,961,504 | A * | 6/1976 | Sprecher | 70/1.5 |
| 4,518,180 | A | 5/1985 | Kleefeldt et al. | |
| 4,858,971 | A * | 8/1989 | Haag et al. | 292/201 |
| 5,127,686 | A * | 7/1992 | Gleason et al. | 292/216 |
| 5,497,641 | A * | 3/1996 | Linde et al. | 180/289 |
| 5,685,579 | A * | 11/1997 | Funk et al. | 292/216 |
| 5,802,894 | A | 9/1998 | Jahrsetz et al. | |
| 5,901,991 | A | 5/1999 | Hugel et al. | |
| 5,997,055 | A * | 12/1999 | Strathmann | 292/201 |
| 6,002,341 | A * | 12/1999 | Ohta et al. | 307/10.1 |
| 6,109,671 | A * | 8/2000 | Roncin et al. | 292/216 |
| 6,332,634 | B1 * | 12/2001 | Fukumoto et al. | 292/201 |
| 6,338,508 | B1 * | 1/2002 | Kleefeldt | 292/201 |
| 6,386,599 | B1 * | 5/2002 | Chevalier | 292/201 |

FOREIGN PATENT DOCUMENTS

| | | |
|---|---|---|
| DE | 3313702 | 10/1984 |
| DE | 197 00 887 A1 | 7/1998 |
| EP | 0 106 725 A1 | 9/1983 |
| EP | 0589158 | 3/1994 |
| EP | 0 978 609 A1 | 2/2000 |
| GB | 1 463 571 | 2/1997 |
| GB | 2 330 620 A | 4/1999 |

OTHER PUBLICATIONS

Search Report Under Section 17 dated Nov. 9, 2000.
European Search Report dated Aug. 3, 2003.

* cited by examiner

*Primary Examiner*—Brian E. Glessner
*Assistant Examiner*—Carlos Lugo
(74) *Attorney, Agent, or Firm*—Carlson, Gaskey & Olds

(57) ABSTRACT

A latch assembly includes a latch bolt, a retaining member and an actuator. The latch bolt is moveable between a closed position at which it is capable of retaining a striker and an open position at which the striker is released. The retaining member is moveable between a retained position at which it retains the latch bolt in at least its closed position and released position at which the latch bolt can move between its opened and closed positions. The actuator is capable of moving the retaining means from its engaged position to its released position, in which, under normal operating conditions of the latch, the actuator is the sole means of releasing the latch.

20 Claims, 6 Drawing Sheets

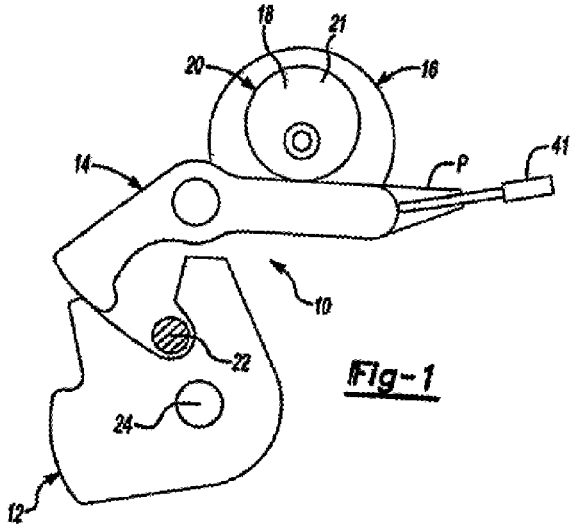

Fig-1